United States Patent [19]

Vayas et al.

[11] Patent Number: 4,525,892

[45] Date of Patent: Jul. 2, 1985

[54] PAIL COVER HAVING MOPWRINGER

[76] Inventors: John Vayas, 11 Midland Pl., Newark, N.J. 07106; Konstantinos Zembilis; Lemonia Zembilis, both of 6 Winthrop Pl., Maplewood, N.J. 07040

[21] Appl. No.: 446,958

[22] Filed: Dec. 6, 1982

[51] Int. Cl.[3] ..... A47L 13/142

[52] U.S. Cl. ..... 15/263

[58] Field of Search ..... 15/260, 263, 264; 220/23, 72; 206/5.1

[56] References Cited

U.S. PATENT DOCUMENTS

| | | | |
|---|---|---|---|
| 217,675 | 7/1879 | Boswell | 15/263 |
| 560,144 | 5/1896 | Michales | 15/263 |
| 877,621 | 1/1908 | Whitehurst | 15/263 |
| 1,138,570 | 5/1915 | Humphries . | |
| 1,405,201 | 1/1922 | Gates . | |
| 1,824,311 | 9/1931 | Van Daam | 15/263 |
| 1,882,918 | 10/1932 | Robb . | |
| 1,943,449 | 1/1934 | Marshall | 15/260 |
| 2,090,867 | 8/1937 | Hornung . | |
| 2,143,846 | 1/1939 | Giddings . | |
| 2,149,255 | 3/1939 | Fader . | |
| 2,171,387 | 8/1939 | Bennett . | |
| 3,341,876 | 9/1967 | Campbell | 15/260 |
| 3,383,732 | 5/1968 | James et al. . | |

FOREIGN PATENT DOCUMENTS

| | | |
|---|---|---|
| 577267 | 5/1946 | United Kingdom . |
| 603403 | 6/1948 | United Kingdom . |

*Primary Examiner*—Edward L. Roberts

*Attorney, Agent, or Firm*—Thomas L. Adams

[57] ABSTRACT

This invention relates to a mop and pail accessory which is a removable pail cover. The pail cover has a circular 360° lip; a large semicircular opening within the circular lip; a basket wringer disposed opposite the large, semicircular opening; a reinforcing rib between the opening and the wringer; and a plurality of drainage holes located proximate to the wringer.

15 Claims, 5 Drawing Figures

PAIL COVER HAVING MOPWRINGER

BACKGROUND OF THE INVENTION

This invention relates to a new and useful accessory for use with mops and pails.

Conventional mops are usually squeezed by mechanical rollers or clamps or by a strainer or wringer affixed to one end of the mop pail. Such wringing or squeezing devices suffer from the disadvantage of being relatively easy to dislodge from the portion of the pail to which they are attached. They are also likely to result in spills.

The present invention has for its object the elimination of the aforementioned drawbacks and accordingly to provide an accessory for use with mops and pails, which is removable but not easy to accidentally dislodge during use and which provides for spill-free squeezing and wringing of a mop.

SUMMARY OF THE INVENTION

According to the principles of the present invention there is provided a removable cover for a pail having means for wringing a mop. The cover has a panel sized to cover the pail. The panel has an encircling lip. This lip has an underside shaped to engage the pail on its top. The panel has an opening sized to pass the mop and spaced from and alongside the lip. Also included is a basket wringer depending from the panel. The panel has an aperture over the wringer to allow access thereto by the mop. The panel has a plurality of drainage holes disposed about the wringer. The cover also has a reinforcing rib affixed to the panel between the basket wringer and the opening.

The preferred pail cover of the invention is placed on the pail and a mop is inserted through the semicircular opening for use of the washing fluid within the pail. When squeezing or wringing of the mop is necessary, the mop is wrung by inserting it into the basket wringer and rotating the mop handle. The configuration of the basket wringer has vertical spokes that inwardly project to catch the strands of the mop and facilitate wringing. The bottom of the preferred basket wringer has a drainage aperture, which, along with the plurality of drainage holes in the cover located proximate to the basket wringer, prevent spillage and puddling during the wringing operation. The reinforcing rib of the cover enables it to sustain the wringing forces without deformation.

BRIEF DESCRIPTION OF THE DRAWINGS

The above brief description as well as further objects, features and advantages of the present invention will be more fully appreciated by reference to the following detailed description of presently preferred, but nonetheless illustrative embodiments in accordance with the present invention when taken in conjunction with the accompanying drawings wherein.

DETAILED DESCRIPTION OF THE PREFERRED EMBODIMENTS

Figure 1:
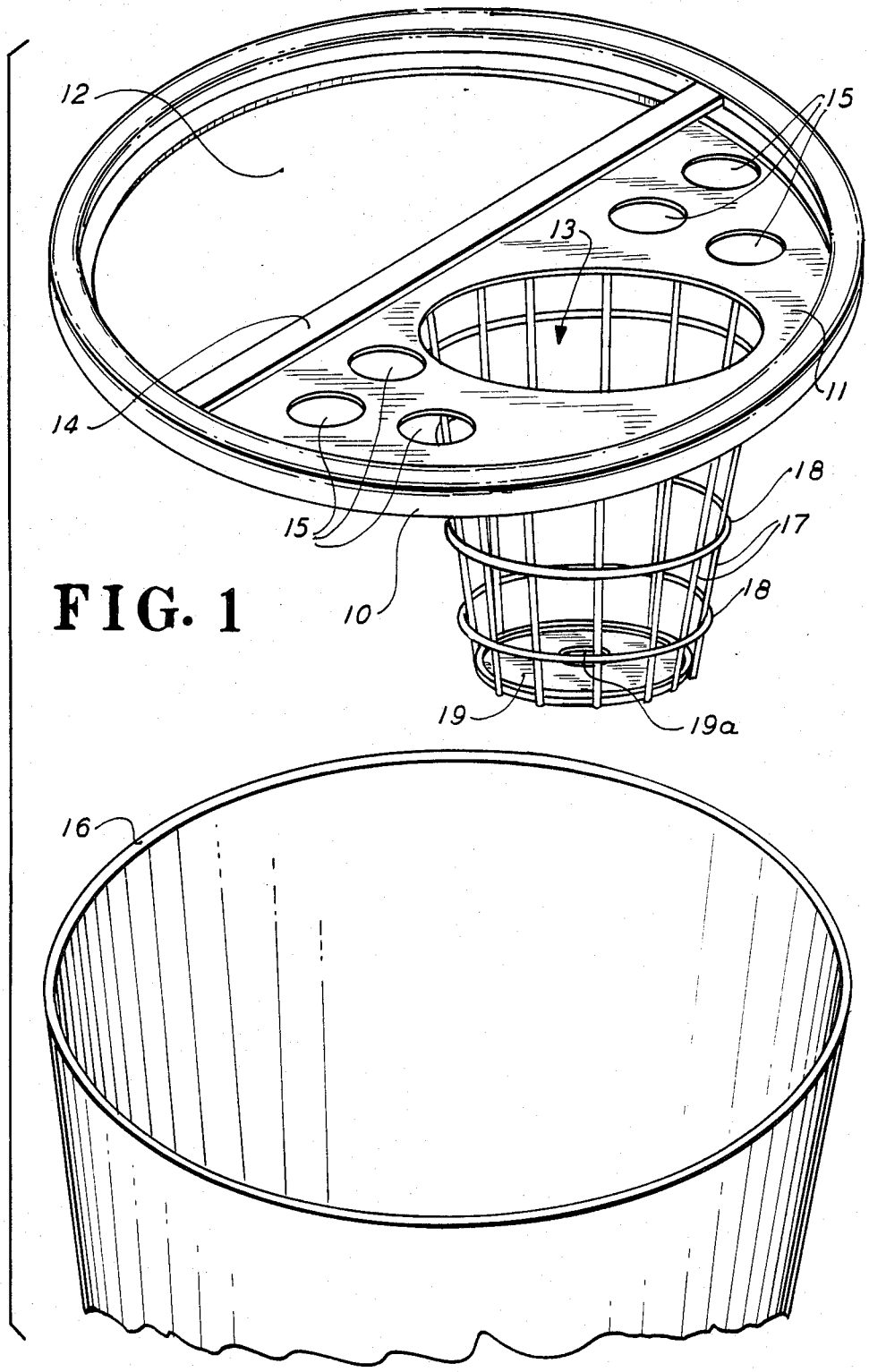
FIG. 1 is a perspective view of the cover and a portion of a pail in accordance with the present invention.
Figure 2:
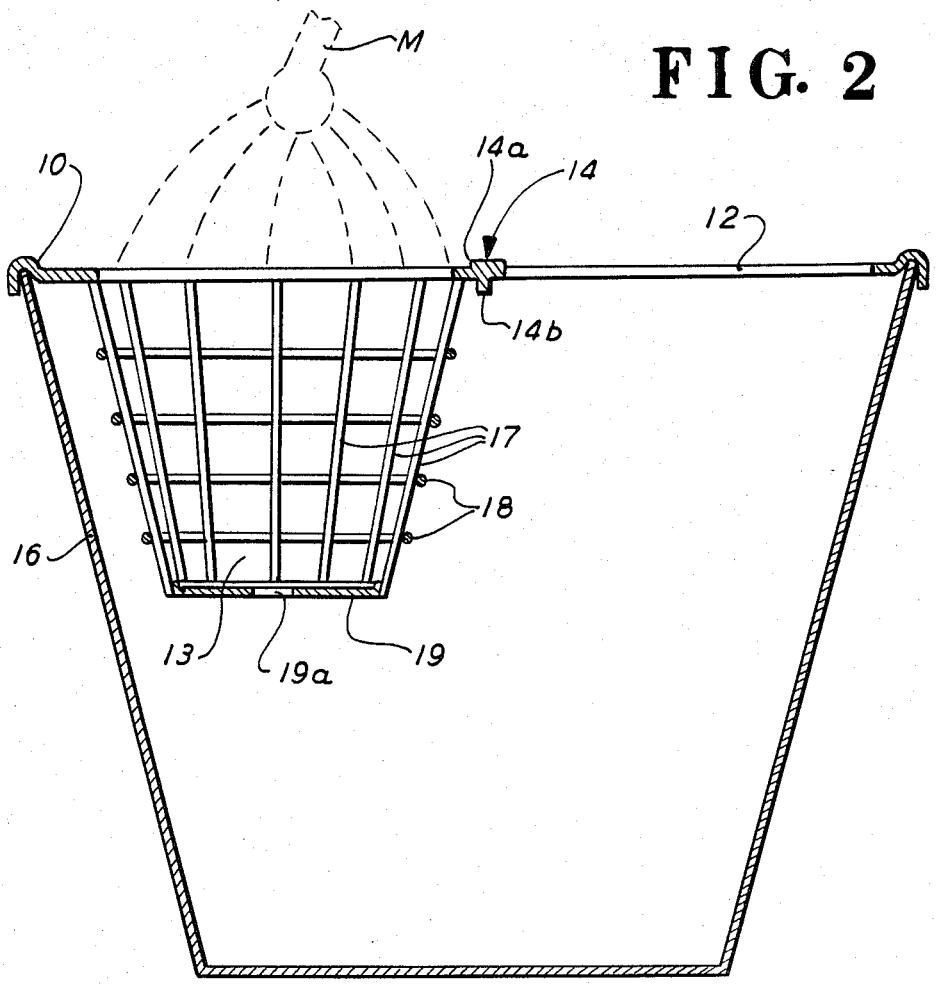
FIG. 2 is a central vertical section of the cover and a pail of FIG. 1.

Referring to FIGS. 1 and 2, the removable pail cover comprises a circular 360° lip 10 encompassing a panel 11. Panel 11 has a relatively large, semicircular opening 12 surrounded by circular lip 10. Basket wringer 13 is disposed opposite large, semicircular opening 12 within circular lip 10. Reinforcing rib 14 diametrically spans the circular lip 10 between the large, semicircular opening 12 and basket wringer 13. It will be appreciated that the size and shape of opening 12 can be varied to accomodate the passage through it of a mop, such as mop M, shown in phantom in FIG. 2. While a semicircular opening uses space efficiently, other configurations are comtemplated.

Rib 14 is shown having an upper flange in the nature of ridge 14*a*. To enhance the reinforcing properties of rib 14 it also has dependent, perpendicular rib 14*b*, spaced inwardly from opening 12. Shaped in this fashion, rib 14 prevents deformation of panel 10 and provides a firm edge for scraping mop M. A plurality of drainage holes 15 are located proximate to the basket wringer 13 so as to provide drainage for any excess water which may drip from the mop during a wringing or squeezing operation. To avoid weakening panel 11, holes 15 are grouped into two equilateral trios on opposite sides of panel 11. Preferably, the cover will contain 4–8 drainage holes 15. In a highly preferred embodiment, the cover will contain six drainage holes 15 each having a diameter of about ½ to 2 inches. These dimensions are given for a preferred embodiment and may be, of course, altered without departing from the scope of the invention. The cover is preferably sized so as to precisely fit the top of the pail 16. In a highly preferred embodiment, the cross-sectional configuration of the circular 360° lip 10 has an inverted U-shaped configuration as shown by the central vertical section view of FIG. 2 so that the lip 10 is adapted to engage the upper edge of the pail 16. However, other configurations, such as an inverted "V"-shape or a "T"-shape may also be utilized. The cover may be composed of metal, plastic or plastic-covered material. A preferred embodiment of this invention employs cover material of molded plastic. Such a material provides a cover having the necessary structural strength and with sufficient durability to withstand constant usage.

Basket wringer 13 may be of a variety of configurations. In a highly preferred embodiment, basket wringer 13 comprises upright spokes 17 that inwardly project to form an inverted, truncated conical interior portion. Horizontal bands 18 are attached integrally to the outside of vertical spokes 17. A floor portion 19 is attached to the bottom of spokes 17. Floor 19 contains drainage aperture 19*a*. This drainage aperture 19*a* further facilitates the drainage of washing fluid during the wringing and squeezing operation.

Figure 3:
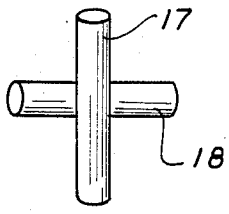
FIG. 3 is a fragmentary detail view of the intersection of a spoke and band of FIG. 1.
Figure 4:
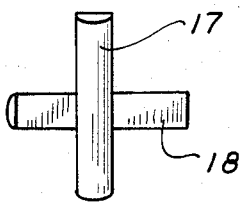
FIGS. 4 and 5 are fragmentary detail views of two alternate spokes and bands for the basket wringer.
Figure 5:
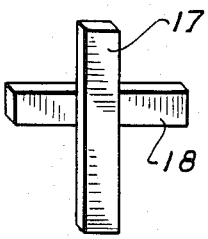

The spokes 17 and horizontal bands 18 can be any of a variety of configurations as shown in FIGS. 3–5. Thus, as shown in FIG. 3, the vertical spokes 17 and horizontal bands 18 can be of a circular cross-section. Alternately, as shown in FIG. 4, the vertical spokes 17 and horizontal bands 18 can be of a semi-circular cross-section. In this embodiment elements 17 and 18 have flat sides facing each other. FIG. 5 illustrates a third embodiment where the vertical spokes 17 and horizontal bands 18 possess a square cross-sectional area. Additionally, the vertical spokes 17 and horizontal bands 18 can each possess different cross-sectional shapes. While the vertical spokes 17 and horizontal spokes 18 can intersect, it is preferred for the horizontal bands 18 to be located so as to cross the vertical spokes 17 on the exterior side of the basket wringer 13. This provides a better corrugated surface on the interior of the basket wringer 13 to additionally facilitate the wringing and squeezing of the mop.

To facilitate an understanding of the principles associated with the foregoing accessory, the use of the cover of FIGS. 1–3 will be briefly described. It will be appreciated that except for subtle differences in the manner of engaging mop strands, the alternate embodiments of FIGS. 4 and 5 will function similarly. Pail 16 is initially filled with the appropriate cleaning fluid such as a detergent. The cover is installed by placing lip 10 over the top edge of pail 6 and pressing downwardly to secure cover to pail. The mop M may now be inserted through opening 12 for the usual purpose.

Thereafter mop M may be wrung by inserting its head into basket 13. Mop M may be twisted to wring it, spokes 17 engaging the mop strands. It will be appreciated that if bands 18 were interior bands they would allow the mop to turn relatively unimpeded so that little wringing would occur. The user may bear down on mop M since rib 14 prevent excessive flexing of panel 11. During this wringing operation water may leave basket 13 through the side spokes or through floor hole 19*a*.

A unique cooperation exists between rib 14 and holes 15. Rib 14 is greatly reinforced and, in fact rises over the level of panel 11. While such a heavy rib prevents flexing or breakage, fluid cannot easily run over rib 14 into pail 16. However drainage holes 15 allows use of a heavy rib without causing puddling on panel 11 which could lead to spills. Moreover holes 15 are positioned away from the center of panel 11 where the greatest stress exists.

The foregoing embodiments may be varied dimensionally to provide the specific size of cover required. The materials utilized for the cover may also be varied. It is expected that embodiments will employ aluminum, steel, other metals, plastics and plastic and rubber coated metals depending upon the particular use of the cover and accompanying pail. For instance, a cover and pail for household use may be plastic, while one suited for institutional use would preferably be of aluminum, steel, or plastic coated metal. Obviously, many other modifications, both of materials and methods of the present invention are possible in light of the above teachings. It is therefore to be understood that within the scope of the appended claims, the invention may be practiced otherwise than as specifically described.

What is claimed is:

1. A removable cover for a pail having means for wringing a mop, comprising:

a panel sized to cover said pail and having an encircling lip, said lip having an underside shaped to detachably engage said pail on its top, said panel having an opening sized to pass said mop and spaced from and alongside said lip, said opening having an edge defining a circular arc, said panel being formed of a plastic material;

a basket wringer depending in a direction internally and substantially perpendicular from said panel, said panel having an aperture over said wringer to allow access thereto by said mop, said panel having a plurality of drainage holes disposed about said wringer and positioned away from the center of said panel where the greatest stress exists; and a reinforcing rib affixed to said panel between said basket wringer and said opening, said rib being sized to restrict the flexing of said plastic material of said panel, said rib having a first section depending from said panel in the same direction as said wringer and a second section depending from said panel in an opposite direction; and said drainage holes and said second rib section being cooperatively arranged to avoid puddling of liquid on said panel.

2. A cover according to claim 1 wherein said lip encompasses 360° and has an inverted U-shaped cross-sectional configuration adapted to engage the upper edge of the pail, the top of said lip being higher than said panel, whereby spillage is reduced.

3. A cover according to claim 2 wherein the basket wringer comprises:

a plurality of upright, spaced, inwardly projecting spokes conically disposed to define an inverted, truncated conical interior;

a plurality of transverse bands transversely affixed to said spokes, said spokes being positioned inwardly more than said bands to restrict axial rotation within said basket wringer by the mop; and an apertured floor depending from said spokes.

4. A cover according to claim 3 wherein said opening is semicircular and has a straight edge parallel to said rib.

5. A cover according to claim 3 wherein said transverse bands are positioned at the outside of said spokes.

6. A cover according to claim 5 wherein said spokes and bands are integral and formed into a single unit.

7. A cover according to claim 6 wherein said spokes have a round cross-section.

8. A cover according to claim 7 wherein said bands are toroidal.

9. A cover according to claim 6 wherein said spokes and bands have a semicircular cross-section, said spokes and bands each having a flat side, the flat side of each of said bands facing the flat side of each of said spokes.

10. A cover according to claim 3 wherein said floor is an annular flat plate.

11. A cover according to claim 10 wherein the diameter of said wringer is substantially half that of said opening in said panel.

12. A cover according to claim 1 wherein said rib completely spans said panel so that weak points are avoided in said panel.

13. A cover according to claim 1 wherein said drainage holes are even in number and are arranged in two groups of equal number on opposite sides of said aperture for said wringer.

14. A cover according to claim 13 wherein said cover is molded from plastic.

15. A removable cover for a pail having means for wringing a mop, comprising:

a panel sized to span said pail and having a supporting lip means for supporting said panel, said lip means having an underside shaped to detachably engage said pail on its top at positions spaced at least half the pail circumference, said panel leaving a passage to said pail sized to pass said mop and spaced from and alongside said lip means, said panel being formed of a plastic material;

a basket wringer depending in a direction internally and substantially perpendicular from said panel, and having crossed members forming a grid, said panel having an aperture over said wringer to allow access thereto by said mop, said panel having a plurality of peripheral gaps disposed about said wringer for allowing drainage into said pail, said panel including an upright reinforcing rib affixed to said cover between said basket wringer and said passage, said rib being sized to restrict the flexing of said plastic material of said panel, said rib having a first section depending from said panel in the same direction as said wringer and a second section depending from said panel in an opposite direction; and said plurality of peripheral gaps and said second rib section being cooperatively arranged to avoid puddling of liquid on said panel.

* * * * *